US005580394A

United States Patent [19]

Freytag

[11] Patent Number: 5,580,394

[45] Date of Patent: Dec. 3, 1996

[54] METHOD FOR CLEANING INDUSTRIAL PARTS INCLUDING SEQUENTIAL DIRECT SPRAY AND IMMERSION OF THE PART

[75] Inventor: David C. Freytag, Cincinnati, Ohio

[73] Assignee: Airtronic, Inc., Cincinnati, Ohio

[21] Appl. No.: 209,970

[22] Filed: Mar. 14, 1994

Related U.S. Application Data

[63] Continuation-in-part of Ser. No. 89,842, Jul. 12, 1993, abandoned.

[51] Int. Cl.[6] ..... B08B 3/02; B08B 3/06

[52] U.S. Cl. ..... 134/10; 134/21; 134/26; 134/30; 134/33

[58] Field of Search ..... 134/33, 10, 11, 134/25.4, 30, 31, 120, 153, 107, 159, 157, 21, 26; 239/589, 590; 68/58

[56] References Cited

U.S. PATENT DOCUMENTS

| | | | |
|---|---|---|---|
| 915,898 | 3/1909 | Souchurek, Sr. | 134/145 |
| 2,198,412 | 4/1940 | McDonald | 210/771 |
| 2,239,904 | 4/1941 | Soderberg | 134/159 |
| 2,358,507 | 9/1944 | Haberstump | 134/72 |
| 2,546,385 | 3/1951 | Christina | 134/89 |
| 2,570,021 | 10/1951 | Beach | 134/199 |
| 2,673,835 | 3/1954 | Kearney | 134/79 |
| 2,675,011 | 4/1954 | Maddaford | 134/79 |
| 2,767,110 | 10/1956 | Frekko | 134/23 |
| 2,893,410 | 7/1959 | Frekko | 134/144 |
| 3,134,203 | 5/1964 | Roberts | 451/328 |
| 3,192,935 | 7/1965 | Hanifan | 134/142 |
| 3,302,655 | 2/1967 | Sasaki et al. | 134/79 |
| 3,578,002 | 5/1971 | Rowan et al. | 134/25.4 |
| 3,606,896 | 9/1971 | Holm | 134/79 |
| 3,624,750 | 11/1971 | Peterson | 134/96 |
| 3,744,402 | 7/1973 | Piegza et al. | 99/360 |
| 3,853,622 | 12/1974 | Rutten | 134/25.4 |
| 3,904,346 | 9/1975 | Shaw et al. | 427/29 |
| 3,935,719 | 2/1976 | Henderson | 68/58 |
| 3,991,779 | 11/1976 | Saurenman | 134/159 |
| 4,170,488 | 10/1979 | Norman | 134/10 |
| 4,186,032 | 1/1980 | Ham | 134/31 |
| 4,330,375 | 5/1982 | Wörz et al. | 204/35 R |
| 4,344,448 | 8/1982 | Potts | 134/73 |
| 4,353,381 | 10/1982 | Winters | 134/111 |
| 4,391,016 | 7/1983 | Kawamura et al. | 15/302 |

(List continued on next page.)

*Primary Examiner*—Jan H. Silbaugh
*Assistant Examiner*—Saeed Chaudhry
*Attorney, Agent, or Firm*—Wood, Herron & Evans, P.L.L.

[57] ABSTRACT

A method for cleaning industrial parts includes sequentially and alternately exposing the parts to direct free-air impingement spray and immersion cleaning. Contaminated or dirty industrial parts stored or contained in a tote are cleaned by placing them in a rotating wash drum which includes a compartment for securing the tote within the wash drum. During the cleaning cycle, the wash drum rotates about a generally horizontal axis thereby tumbling the parts from the tote secured in the wash drum to a perforate wall section of the wash drum and then back into the tote. The parts are sprayed by a number of specially designed nozzles which are positioned within the wash drum and directed radially downward. The parts are alternately exposed to direct free-air impingement spraying when they are disposed on the perforate wall section of the drum and then to immersion cleaning when they are contained within the tote. An immersion bath accumulates within the tote from the spray while the tote is in the lower arc of the drum's rotation. The nozzles are preferably stepped expansion nozzles which disburse superheated water with controlled vaporization to create high velocity droplets impinging upon the contaminated parts. The method of this invention includes filtering and collecting the water from the wash drum for recycling and reuse within the system.

37 Claims, 2 Drawing Sheets

U.S. PATENT DOCUMENTS

| | | | |
|---|---|---|---|
| 4,414,037 | 11/1983 | Friedheim | 134/35 |
| 4,432,111 | 2/1984 | Hoffmann | 68/58 |
| 4,561,903 | 12/1985 | Blaul | 134/10 |
| 4,565,583 | 1/1986 | Venetta | 134/12 |
| 4,710,233 | 12/1987 | Hohmann et al. | 134/1 |
| 4,778,532 | 10/1988 | McConnell et al. | 134/10 |
| 4,794,661 | 1/1989 | Durazzani | 68/58 X |
| 4,962,776 | 10/1990 | Liu et al. | 134/11 |
| 5,052,332 | 10/1991 | Hajek et al. | 118/72 |
| 5,054,692 | 10/1991 | Foster et al. | 239/589 |
| 5,064,487 | 11/1991 | Fourné | 156/155 |
| 5,113,882 | 5/1992 | Gileta | 134/19 |
| 5,219,370 | 6/1993 | Farrington et al. | 68/58 X |
| 5,345,637 | 9/1994 | Pastryk et al. | 68/58 X |

METHOD FOR CLEANING INDUSTRIAL PARTS INCLUDING SEQUENTIAL DIRECT SPRAY AND IMMERSION OF THE PART

This application is a Continuation-In-Part application of application Ser. No. 08/089,842, filed Jul. 12, 1993 now abandoned.

BACKGROUND OF THE INVENTION

This invention relates to a system for cleaning machined industrial parts. More particularly, it relates to a system for cleaning machining oil, coolants and contaminants from industrial parts.

During the manufacture of industrial parts, the parts are commonly exposed to and contaminated by a wide variety of liquids and chemicals. For example, during the machining process, the parts very commonly become contaminated with machining oil and other hard-to-remove coolants and lubricants at some point in the manufacturing process. The machined parts must be completely cleaned of these machining oils, coolants and/or other contaminants.

One prior solution for cleaning industrial parts contaminated with machining oil and other oil based contaminants is vapor degreasing. Vapor degreasing methods use chemical solvents such as trichloroethylene to remove the contaminants by exposing the parts to vapors of the chemical solvents. Although vapor degreasing has proven to be effective in removing the contaminants from the parts, it is very expensive. The high cost of vapor degreasing is due to the ever increasing cost of the chemicals such as trichloroethylene, the requirements for the environmentally safe disposal of the expended chemicals, and the cleaning of the vapor degreasing system itself. Regulations which are intended to reduce the use of toxic chemicals and to ensure the proper disposal of such waste lead to the increased cost of cleaning industrial parts by vapor degreasing.

Another prior solution for the cleaning of industrial parts is aqueous parts washers. Aqueous parts washers repeatedly wash the parts with combinations of water, soaps and detergents. However, even after washing and rinsing in aqueous parts washers, particularly intricate parts or parts with difficult to remove contaminants can require additional cleaning operations. Furthermore, the soaps and detergents become ineffective after extended use and must be replaced. Likewise, the waste wash water containing the detergents and soaps must be extensively filtered prior to disposal. In addition, the replacement of spent detergents and soaps and the filtration of the waste wash water render the aqueous parts washers very costly to operate. Therefore, the cost of such cleaning systems has proven to be excessive, even though the aqueous based systems are not entirely effective.

Aqueous parts washers typically clean the part or work piece in either of two cleaning modes: spraying or immersion. Those parts washing systems which employ spraying often project the spray through a wire mesh basket or other perforate structure containing the parts. The effectiveness of the spray is diminished by the mesh or perforate structure which impedes the spray prior to contact with the parts.

For example, U.S. Pat. No. 4,353,381 issued to Winters on a cleaning apparatus for automotive parts or the like. The parts are deposited into a wire mesh basket and a cleaning fluid is sprayed onto the parts through the wire mesh basket. As a result, the spray and its cleaning effectiveness is inhibited by the wire mesh basket prior to contacting the parts.

Alternatively, aqueous parts washers commonly employ immersion as the cleaning mode in which the parts are submerged in a cleaning solution bath. In some cases these immersion type washers require the parts to be transferred to a drum in which they are repeatedly tumbled into and out of the bath of cleaning solution. However, during the tumbling process, the bath becomes contaminated and ineffective for cleaning. Worse yet, the parts are exposed to the contaminated bath and the chemicals and other contaminates previously removed from the parts accumulate back onto the parts.

Representative of such immersion type drum washers are U.S. Pat. Nos. 3,134,203 and 3,578,002 issued to Roberts and Rowan, respectively. Each of these patents discloses a system in which the work pieces are tumbled into and out of a cleaning solution or bath. But each of these systems suffer because the bath into which the parts are immersed becomes contaminated with residue previously removed from the parts, thereby diminishing the overall cleaning effectiveness of these systems.

Another form of immersion type washers employ an agitated bath in which the parts are submerged. The parts are typically contained in a basket and immersed in a bath. The bath is agitated, for example by underwater air jets or ultrasound waves, to enhance the cleaning effect. However, the parts are still exposed to a contaminated bath with this type of immersion wash system.

In an effort to improve upon pure immersion type washers or pure spraying type washers, U.S. Pat. Nos. 2,675,011 and 3,302,655, issued to Maddaford and Sasaki, respectively, disclose apparatus for bottle washing which utilizes both spray and immersion modes of cleaning. The bottles are individually retained in compartments or radial carriers on the outer periphery of a rotating disk or drum. The bottles are sequentially sprayed and immersed into a bath as they rotate on the drum or disk. A problem associated with these systems though is a requirement for a complex parts or bottle handling mechanism which loads and removes the bottles. Each bottle must be individually loaded and retrieved from the drum or disk, thereby requiring a complex handling mechanism. A further problem with these systems, is the contamination of the immersion bath as previously described in reference to other immersion type systems. Contaminates and residue previously removed from the bottles or parts accumulate in the bath and can be deposited back onto the bottles or parts which are to be cleaned.

SUMMARY OF THE INVENTION

It has therefore been an objective of this invention to provide an improved parts cleaning system in which the parts are more completely cleaned and in a less expensive manner than has heretofore been the practice.

It has been a further objective of this invention to provide such a cleaning device and system which effectively and inexpensively cleans industrial parts of machining oils and contaminants and which is environmentally safe.

Another objective of the invention has been to provide an aqueous cleaning system which effectively cleans oil and other contaminants from the parts in a cost effective and time efficient manner and which does so while recycling wash water used in the cleaning operation.

In accordance with the invention of this application, these objectives are attained by a rotating wash drum cleaning system which employs a combination of direct free-air impingement spraying and total immersion of the parts or work pieces to be cleaned. As used herein, the terms "direct free-air impingement spraying" or "direct impingement spraying" refer to a spray which impacts the parts to be cleaned directly without any interference from an intervening basket, wire mesh, perforate structure, or other apparatus upon exiting a spray nozzle. In its preferred embodiment, the cleaning system according to this invention incorporates a tote or drawer into which the parts to be cleaned may be directly inserted and secured within the wash cabinet and then removed after the wash cycle with the cleaned parts contained therein.

The rotating parts wash drum includes an annular wash drum mounted on a concentric rotating shaft. The shaft is powered by a motor to rotate the wash drum about a generally horizontal axis. A plurality of stationary stream jet nozzles are mounted at the center of the wash drum and are preferably directed radially downward. The upper portion of the wash drum is constructed of a perforated sheet metal wall with sheet metal baffles projecting radially inwardly toward the axis of rotation of the drum. The lower portion of the wash drum includes compartments for removably securing the tote or drawer containing the parts to be cleaned.

In operation, the wash drum rotates upon the central shaft around the spray jet nozzles. The rotation of the drum successively tumbles the parts from the totes or drawers to the perforated sheet metal portion of the drum and then back into the totes. The downwardly directed spray on the nozzles impinges directly upon the parts when they are in the perforated sheet metal portion of the drum and accumulates in the totes as they pass beneath the nozzles to form a bath of cleaning solution in the totes. As the parts tumble into the totes due to the rotation of the drum, they are immersed in the cleaning solution bath. As a result, the parts are alternately and repeatedly subjected to a direct free-air impingement spray from the nozzles followed by immersion in a clean bath of cleaning solution accumulated from the spray in the totes. Unlike prior immersion type cleaning systems, the bath is not contaminated with residue previously removed from the parts. The bath drains from each tote and out of the wash drum during each rotation and the tote is filled with spray or water directly from the nozzles each successive rotation of the drum.

The water is released through a plurality of nozzles within the wash drum. The nozzles may include any type of nozzle. For example, fan-type nozzles which are adapted for wide dispersion of the water for cleaning the external surfaces of the industrial parts can be used. Additionally, specially designed stepped expansion nozzles may preferably be used within the wash drum. As heated and pressurized water exits the stepped expansion nozzles, a portion of the water flashes to steam and this controlled vaporization creates high velocity superheated water droplets impinging upon the parts. The result is an invasive, high temperature direct impingement spray cleaning action which does not require the addition of chemicals or detergents.

The major components of this invention include a wash cabinet housing a rotating drum mounted on a concentric shaft connected to a motor. The rotating drum includes compartments for removably securing the totes containing the parts to be cleaned. The compartments are accessible through an access door in the wash cabinet.

Separate and remote steam generation and filtration systems are configured in a closed loop with the wash cabinet for recycling the water after being used in cleaning the parts. The closed loop configuration of this invention minimizes the overall system operational cost by reducing the fuel requirements to heat the water to an elevated temperature.

The nozzles are fixedly mounted on a central shaft extending through the center of the rotating drum. The nozzles are generally directed downwardly to spray the parts and drum during the lower arc portion of the drum's rotation. After the totes containing the parts are loaded into the specially designed compartments of the drum, a door on the wash cabinet is secured closed thereby sealing the wash cabinet as a closed chamber.

The system is then activated to begin the rotation of the wash drum thereby tumbling the parts from the open uppermost side of the totes secured in the wash drum to the perforate wall section of the drum and then back again into the totes. The water, steam, or other cleaning solution exits the fixed downwardly directed nozzles. When the perforate wall section of the drum is in the lower arc of its rotation, the parts are disposed thereon and exposed to direct free-air impingement spray from the nozzles. A plurality of sheet metal baffles are secured to the perforate wall section and extend radially inwardly toward the nozzles. The baffles control the tumbling of the parts thereby increasing their exposure to the direct free-air impingement spray.

As the drum continues to rotate, the parts tumble from the perforate wall section into the totes. The spray from the nozzles accumulates within the totes thereby forming bathes of cleaning solution in which the parts are immersed. The immersion bath which accumulates in each tote is not contaminated as in other aqueous parts washing immersion type systems because the contaminated cleaning solution is drained from the wash drum through the perforate wall section during each rotation of the drum. Spray directly from the nozzles accumulates in the bath and is therefore not contaminated as in other immersion type systems.

AS a result of the use of the cleaning system and apparatus of this invention, contaminants, including oil and water based lubricants, oil-based dye penetrants, waxes and machining coolants, are efficiently and effectively cleaned from industrial parts. Furthermore, the cleaning is accomplished in a timely and cost effective manner without the use of toxic chemicals and detergents by the utilization of an aqueous solution and, if necessary, superheated water which is recycled within the system for an environmentally sound industrial cleaning application. In addition, transfer of the parts into and out of the wash drum is easily accomplished without individually handling the parts nor with complex parts handling mechanisms within the wash drum. The tote containing the parts is conveniently secured in the wash drum prior to the wash cycle and easily removed afterward with the cleaned parts therein.

BRIEF DESCRIPTION OF THE DRAWINGS

The objectives and features of this invention will become more readily apparent from the following detailed description taken in conjunction with the accompanying drawings in which.

DETAILED DESCRIPTION OF THE INVENTION

Figure 1:
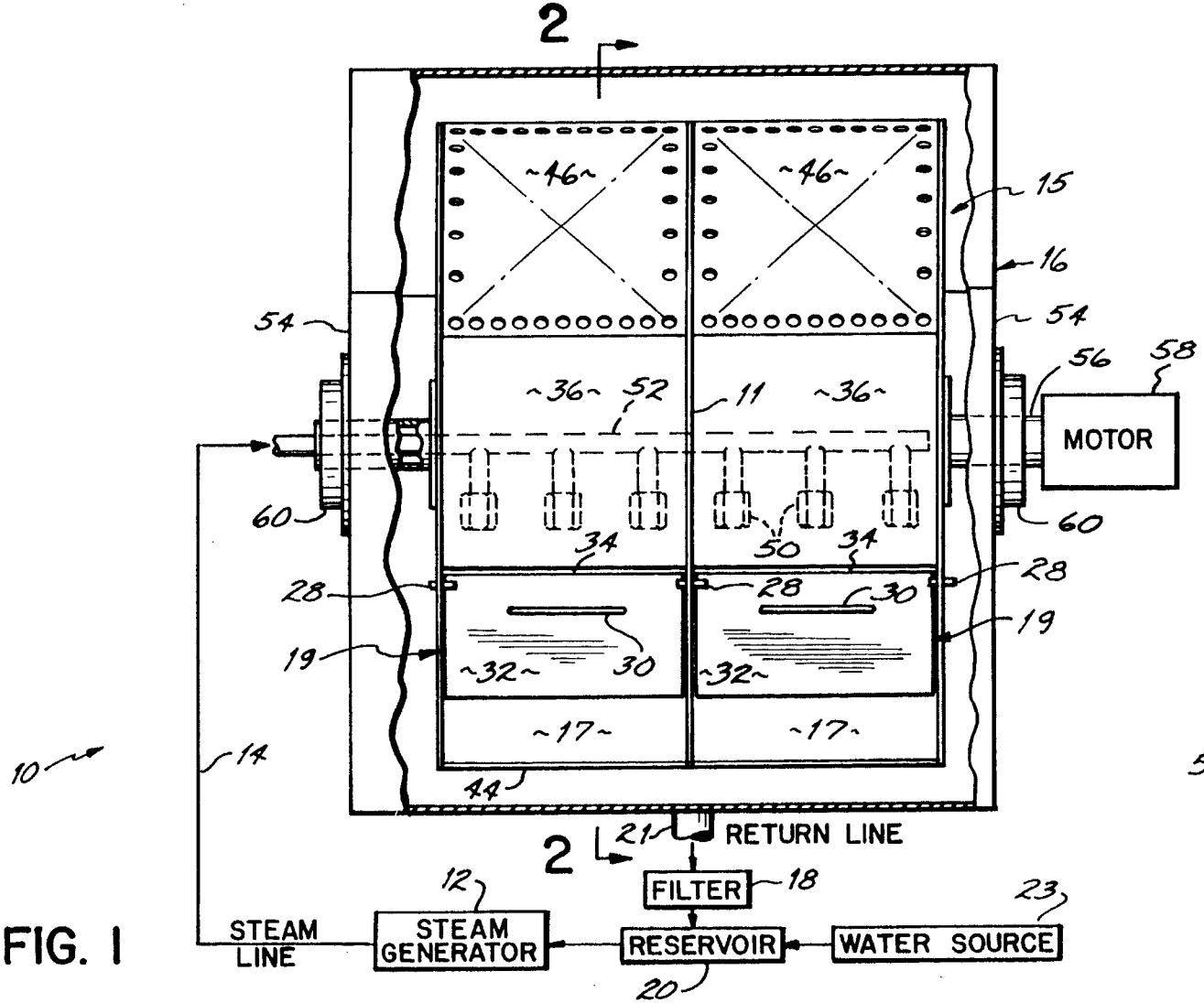
FIG. 1 is a schematic representation of the rotating wash drum system for cleaning industrial parts according to this invention.

A system 10 for cleaning industrial parts according to this invention is shown in FIG. 1. The system 10 preferably includes a steam generator 12 with a steam line 14 for delivering water heated in the steam generator 12 to a wash cabinet 16 containing a wash drum 15. The wash drum 15, preferably approximately 32 inches in diameter, includes a pair of compartments 17, 17, each of which is designed to secure a tote or drawer 19 therein. The compartments 17, 17 are separated by a preferably solid dividing wall 11 which partitions the wash drum 15 into separate side-by-side regions. The tote 19, preferably a standard size parts storage tote measuring approximately 6 inches×24 inches×18 inches, contains dirty or contaminated industrial parts 9 to be cleaned. After the water is sprayed onto the parts 9, it exits the wash cabinet 16 through a return pipe 21 and is fed through a filter 18 to remove any contaminants or impurities therein prior to recycling the water back to the steam generator 12 through a reservoir 20. A water source 23 provides additional water as required to the system 10.

The steam generator 12 is capable of heating water supplied to it to a temperature in the range of 310° to 360° F. The water is preferably delivered to the wash cabinet 16 at a temperature of 325°. A 750,000 BTU or 1,500,000 BTU natural draft self-modulating gas burner (not shown) with thermostat control can be provided in the steam generator 12 for heating the water. The steam generator 12 preferably operates as an on-demand unit so as to only heat the water as required by the system, thereby conserving energy operating costs by not continually heating the water when the system 10 is not in operation. The self-modulating gas burner further reduces heating requirements by adjusting to the incoming water temperature to superheat the water. The water input to the steam generator 12 comes from the water source 23 at ambient temperature and from recycled water which has previously been heated and therefore requires less heat input and fuel to achieve the required 325°. As a result, the self modulating burner is more fuel efficient and less costly to operate.

The superheated water must be pressurized to approximately 100–150 psi in order to prevent it from vaporizing to steam at the elevated temperature. Preferably, a 10 gallon per minute diaphragm pump (not shown) with a 3 horse power electric motor (not shown) is provided with the steam generator 12 in order to pressurize the superheated water and pump it to the wash cabinet 16. A stainless steel control panel (not shown)is provided on the steam generator 12 to include visual function indicators such as pressure, flow, and temperature displays to facilitate the operation of the steam generator 12.

The pipes 14 and 21, in addition to any internal piping within the wash cabinet 16 and the steam generator 12, are preferably constructed of stainless steel in order to prevent rust and degradation and to extend the useful life of the system 10.

The filter 18, positioned in the closed loop system of this invention between the wash cabinet 16 and the reservoir 20, cleans and recycles the water after exiting the wash cabinet 16. The particular filter or filtration system employed with this invention depends upon the particular application, parts to be cleaned and contaminants. For example, a two stage system including a simple particulate filter to remove any large particles from the waste water and a dual cartridge oil absorbing filter may be used. The oil absorbing filter has preferably a 6–10 gallon per minute flow rate capability and up to 3 gallons of oil absorption capacity and is equipped with a built-in pressure gauge, such as the Filterdyne Xilox II oil absorbing filter.

The supply water input to the system 10 through the steam generator 12 preferably has a hardness within the 4 to 8 grains range for acceptable system performance. Otherwise, a water softener (not shown) is required for treating the water input into the system 10. With the recycling capability of the rotating wash drum cleaning system 10 of this invention, a minimal amount of the water will be lost through evaporation during a typical cleaning cycle. However, an optional condenser (not shown) can be included with the system 10 which recoups virtually all of the steam lost in the cleaning process.

A wide access door 24 is pivotally attached to the wash cabinet 16 by hinges 26 to provide access to the wash drum 15 for the loading and unloading of the parts 9. The door 24 includes a handle 25. A latch, locking pin 28 or other appropriate mechanism is provided for securing each tote 19 or drawer within the compartment 17 of the wash drum 15. The tote 19 is preferably rectangular and including a handle 30 on a front side wall 32 thereof and an open uppermost side 34 thereby exposing the parts 9 contained in the tote 19 from the top.

Figure 2:
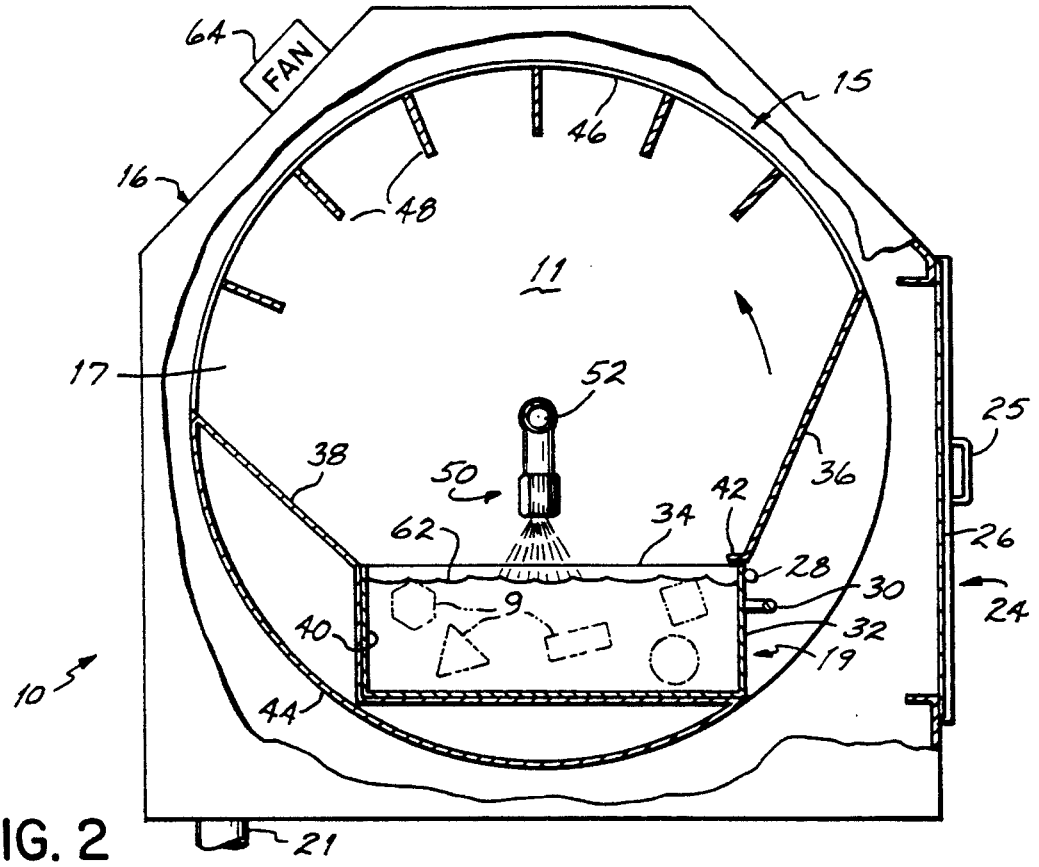
FIG. 2 is a cross-sectional view taken along line 2—2 of FIG. 1.
Figure 3:
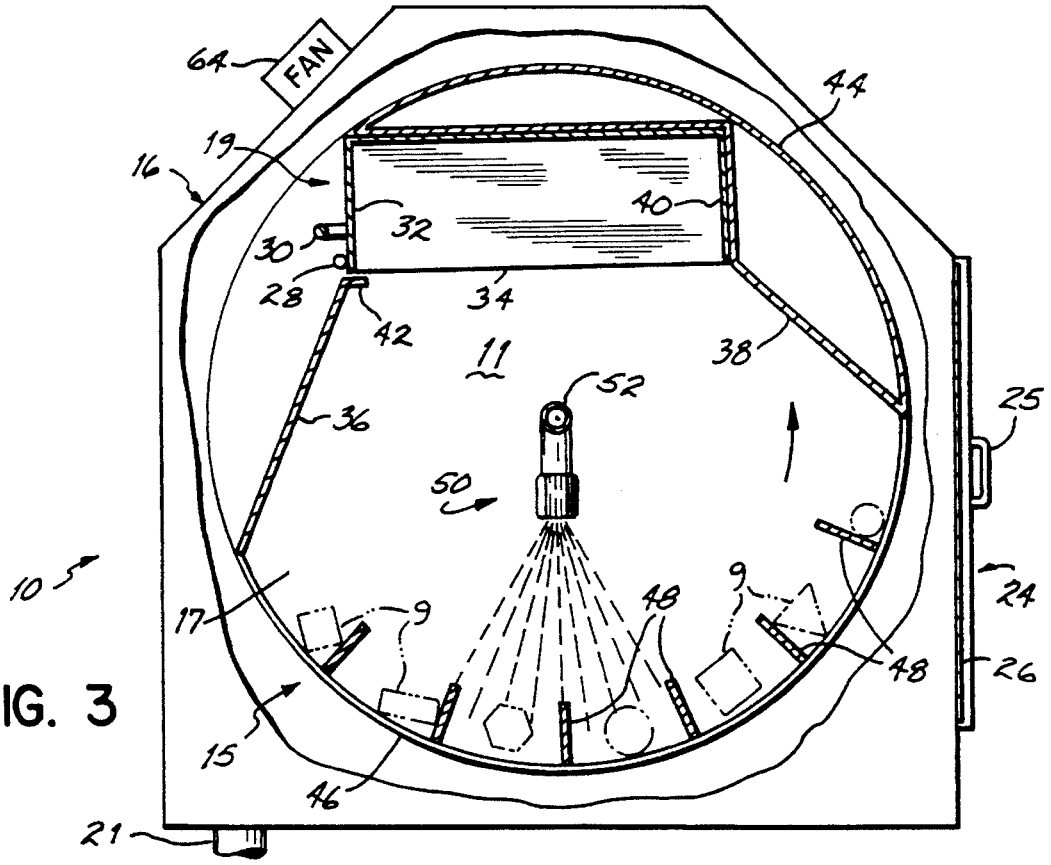
FIG. 3 is a view similar to FIG. 2 with the wash drum rotated approximately 180°.

Within the wash drum 15, a first 36 and a second 38 angularly sloped sidewall extend from the top edges of the front wall 32 and a back wall 40, respectively, of the tote 19 as shown in FIGS. 2 and 3. A lip 42 is provided on the lowermost edge of the first sloped sidewall 36 to provide for the insertion and removal of the tote 19 within the compartment 17 and to direct the parts 9 into the tote 19 during the rotation of the wash drum 15. An arcuate wall section 44 of the wash drum 15 extends from an upper edge of the second sloped sidewall 38 to a forward lower edge of the compartment 17 and underlies the tote 19 and the second sloped sidewall 38. The arcuate wall section 44, first and second sloped sidewalls, 36 and 38, respectively, and the walls of the compartments 17 are each fabricated from solid metallic, preferably stainless steel, sheet metal stock.

An arcuate and perforate wall section 46 joins the uppermost edges of the first and second sloped sidewalls 36 and 38, respectively, in the drum 15. The arcuate drum wall section 46 is perforate to allow for the wash water to drain from the wash drum 15 and ultimately collect in the reservoir 20 during the rotation of the wash drum 15. A number of baffles 48 project radially from the perforate wall section 46 toward the interior or center of rotation of the wash drum 15. The baffles 48 are preferably constructed of solid stainless steel sheet metal stock and control the tumbling of the parts 9 to thereby increase their exposure to the spray exiting a number of nozzles 50.

Figure 4:
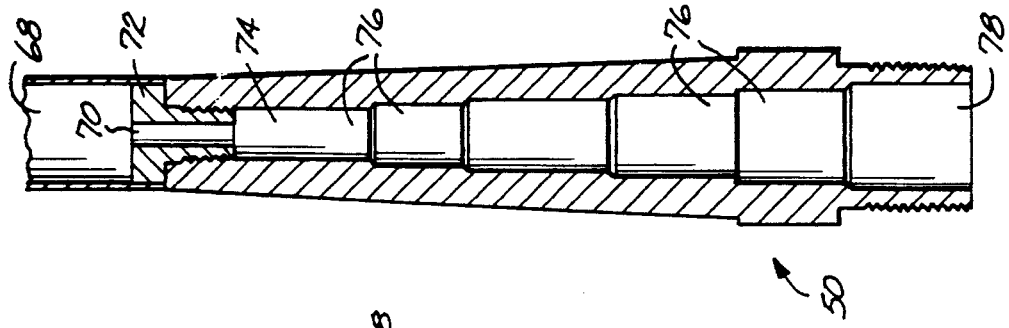
FIG. 4 is a cross-sectional view of a stepped expansion nozzle.

The nozzles 50 employed in this invention are preferably stepped expansion type nozzles as disclosed in U.S. patent application Ser. No. 08/089,842 filed Jul. 12, 1993, the disclosure of which is hereby incorporated by reference. The stepped expansion nozzle 50, as shown in FIG. 4, enhances the cleaning effectiveness of the direct free-air impingement spray by delivering superheated water at high velocity directly to the parts 9. The water delivered to the nozzles 50 is preferably superheated to a temperature typically over 310° F. and maintained at a pressure over 100 psi to ensure that it remains in the liquid state when superheated. The superheated water is forced through a restrictive opening 70 of the stepped expansion nozzle 50. The water is pressured to over 100 psi; however, the rotating drum 15 and wash cabinet 16 remain at ambient pressure so that once the water exits the nozzle 50, it is no longer subjected to the pressurization.

Upon exiting the restrictive opening 70 of the stepped expansion nozzle 50 and entering ambient pressure atmosphere, a portion of the water cools by vaporizing. Typically, from 5 to 15% of the superheated water by volume flashes to vapor upon exiting the restrictive opening 70 of the nozzle 50.

The water which flashes to steam vapor propels the remaining volume of superheated water to an increased velocity after exiting the restrictive opening and passing through the stepped expansion portion of the nozzle. Unlike the standard pressure washer or fan nozzle where the restrictive opening is the last component the water passes through before reaching the part to be cleaned, the stepped expansion nozzle provides for the acceleration of the superheated water and directs the accelerated water toward the parts rather than allowing it to dissipate in all directions.

The expansion or vaporization of a portion of the superheated water within the stepped expansion nozzle 50 increases the velocity of the remaining superheated water impinging upon the contaminated parts 9 to thereby enhance the cleaning of the parts. As a result, the parts are not actually cleaned by vaporized water or steam, according to this invention, but the superheated water remaining in the liquid state is accelerated by portions of water vaporized to steam thereby creating significant kinetic energy for the water to impact upon the contaminated parts 9 for the cleaning thereof.

As shown in FIG. 1, six nozzles 50 are positioned within the wash drum 15 in the preferred embodiment of this invention. The nozzles 50 are preferably fixedly mounted to a water supply pipe 52 extending through the center of the wash drum 15 and secured to sidewall 54 of the wash cabinet 16. However, it will be appreciated by one of ordinary skill in the art that this invention is not limited by the specific type, configuration, placement, or number of nozzles shown in this preferred embodiment. The supply side of the stepped expansion nozzle 50 is connected to a nozzle inlet pipe 68, preferably a 0.5 inch diameter stainless steel pipe. The nozzle inlet pipe 68 feeds the water to the restrictive orifice 70 within a flanged bushing 72 in the nozzle 50. The orifice 70 is preferably 0.098 inches in diameter and leads to a 5/16 inch diameter nozzle entrance 74. The diameter of the nozzle 50 is then increased in a series of steps 76 over a four inch length to an outlet 78 diameter of 5/8 inch. In addition or in combination with the stepped expansion nozzle 50 of FIG. 4, other more standard nozzles can be included in this system 10 which are well known in the art, such as fan-type nozzles.

The superheated liquid water delivered to the stepped expansion nozzle 50 is preferably 325° F., but within a range of 310° F. and 360° F. and at a pressure of 100–150 PSI. The specially designed nozzle 50 for this system converts the enthalpy of the superheated water to kinetic energy to thereby increase the velocity at which the superheated water impinges upon the contaminated parts 9. This is accomplished by decreasing the pressure of the water within the nozzle 50 through the series of stepped expansions.

As the water passes from the nozzle inlet pipe 68 through the orifice 70 to the nozzle entrance 74, there is a significant pressure drop during which a portion of the superheated water vaporizes to steam. The wash drum 15 and steps 76 of the nozzle 50 are maintained at ambient pressure. Therefore, after the superheated pressurized water exits the orifice 70, it experiences a drastic decrease in pressure below the saturated pressure point of steam, thereby vaporizing a portion of the superheated water to steam.

When the water passes through the orifice 70, it is no longer subjected to the additional pressurization and cannot remain a liquid at the elevated temperature. The water cools itself to approximately 212° F. by vaporizing a portion of its volume. Approximately 15% of the superheated water flashes to steam thereby cooling the remaining liquid water within the nozzle 50. The nozzle 50 of this invention directs and adds velocity to the water droplets to thereby increase the velocity with which they impinge upon the contaminated parts 9. The steam vapor propels the remaining water within the nozzle 50 by the release of kinetic energy. For optimal cleaning, the nozzles 50 of this invention should be directed downwardly as shown in FIGS. 1–3. The preferred embodiment of this system 10 is designed to deliver approximately five gallons of superheated water and steam per minute distributed over the six nozzles 50 within the wash drum 15.

A typical cleaning cycle of this invention includes four stages: preheat, wash, cool down, and drying. To begin a cycle, an operator loads the tote 19 containing the parts 9 into the specially designed compartment 17 and secures the tote 19 therein with the latch 28 and closes and secures the door 24 on the wash cabinet 16. It will be appreciated that the figures show a wash drum 15 with two separate compartments 17 for securing totes 19 and that a wash drum 15 with a single or more than two compartments is within the scope of this invention.

The required cleaning time is then selected on the wash timer and the start button on the control panel (not shown) is actuated to begin the cleaning cycle. The system 10 then proceeds automatically through the completion of the four stage wash cycle. During the preheat stage, the modulating burner operates to raise the water temperature to preferably 325° F. for delivery to the wash cabinet 16. Under normal operating conditions, the preheat stage will take approximately 2–4 minutes, even after several hours of inactivity. The modulating steam generator 12 operates on demand with energy expended only when in actual operation to thereby minimize operating costs and fuel requirements.

After the critical temperature of 325° F. is achieved, the wash stage begins and the drum begins to rotate on a horizontal shaft 56, preferably at approximately 3 to 5 RPM. The drum 15 is driven rotationally by a motor 58 and is mounted for rotation on the shaft 56 which is seated in bushings 60 on opposite sides of the cabinet 16. A typical wash stage lasts for 5–10 minutes. The wash stage includes both direct free-air impingement spraying and immersion cleaning of the parts 9. As the drum 15 rotates, the parts 9 tumble from the tote 19 to the second sloped sidewall 38 and then onto the perforated wall section 46 of the drum 15. The parts 9 are disbursed on the perforate wall section 46 between the baffles 48 projecting therefrom and are exposed to direct free-air impingement spraying from the nozzles 50 when the perforate wall section 46 is in the lower portion of the drum's rotation as shown in FIG. 3. The spray impacts and cleans the industrial parts 9 and then drains through the perforate wall 46 to be collected ultimately in the reservoir 20 for recycling and reuse.

With the continued rotation of the drum 15, the parts 9 tumble from the perforate wall section 46 to the first sloped sidewall 36 in the drum 15 and then slide over the lip 42 and back into the tote 19 as shown in FIG. 2. The spray from the nozzles 50 accumulates in the tote 19 thereby forming a cleaning solution bath 62 when the tote 19 is in the lower arc of the wash drum's rotation. The bath 62 is comprised of water and cleaning solution directly from the nozzles 50 and, as a result, is not contaminated with residue previously removed from the industrial parts 9 to thereby provide a more effective cleaning bath. Continued rotation of the wash drum 15 drains the accumulated bath 62 from the tote 19 along with tumbling the parts 9 from the tote 19 towards the second sloped sidewall 38 and the perforated wall section 46. The bath 62 drains from the tote 19 and the wash drum 15 through the perforate wall section 46 and also accumulates ultimately in the reservoir 20 for filtration and recycling. The cleaning process according to this invention continues thusly by alternately exposing the parts 9 to direct free-air impingement spray and immersion cleaning due to the rotation of the wash drum 15.

After the wash stage, the system 10 proceeds to a cool down stage during which the burner is shut down and water is recirculated for approximately 3–4 minutes for cooling within the pipes, wash cabinet, and parts. A high speed exhaust fan 64 can be mounted on the wash cabinet 16 for evacuating any accumulated vapor within the wash cabinet 16 during the cool down stage.

After the cool down stage, the final stage of the cleaning cycle is drying. While the exhaust fan 64 continues to cool the wash cabinet 16 and drum 15, the parts 9 will tend to flash dry from the retained heat transferred to them from the superheated water. An air knife or other appropriate auxiliary air circulation system (not shown) can be coupled to the wash cabinet 16 to enhance the drying process by circulating forced air therein. The drying stage typically lasts 2–3 minutes after which the cycle is complete and a ready light on the control panel indicates that the door 24 on the wash cabinet 16 can be opened to remove the totes 19 containing the cleaned parts 9. Advantageously, not only the parts 9 are cleaned, but the interior of the tote 19 is also cleaned with this invention.

Although the preferred embodiment of this invention is described and shown herein with the tote containing the parts, an alternative embodiment within the scope of this invention encompasses a wash drum in which the parts are deposited directly into the drum without benefit of the tote. The parts can be deposited into the drum through an access door, hatch, compartment, or other such opening in the drum.

A further alternative embodiment within the scope of this invention can be used for more fragile parts which can not withstand tumbling contact with other parts or the wash drum structure. In this embodiment, the parts are inserted into an inner perforate cage which rotates around the fixed nozzles and within the rotating wash drum. The inner perforate cage preferably rotates at a slower rate than the wash drum and passes the parts through the bath when it accumulates in the wash drum. As a result, the parts are exposed to both immersion and spraying modes of cleaning but not the potentially damaging tumbling contact associated with the other embodiments of this invention.

A still further alternative embodiment within the scope of this invention includes a screen, wire mesh or other perforate cover on the tote in the compartment of the wash drum. Such a cover would retain the parts within the tote during rotation of the drum. Nozzles would not only be mounted downwardly but multi-directionally in order to expose the parts to both immersion and spray cleaning. The tote fills with wash water from the downwardly directed nozzles to produce an immersion bath in the lower arc portion of the drum's rotation and the parts are sprayed from the non-downwardly directed nozzles in the remaining portion of the drum's rotation.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof.

We claim:

1. A method of cleaning a work piece comprising the steps of:

placing the work piece within a tote, said tote being open on an uppermost side thereof;

removably securing said tote within a drum such that said uppermost side is open toward an interior of said drum;

rotating said drum about a horizontal axis to thereby repeatedly tumble the work piece within said drum and said tote being secured therein;

spraying a supply of water onto the work piece from at least one nozzle being fixedly mounted within said drum;

accumulating a supply of sprayed water into a bath in said tote after being sprayed onto the work piece; and immersing the work piece in said bath.

2. The method of claim 1 wherein said spraying is direct impingement spraying of the work piece.

3. The method of claim 1 wherein said spraying is directed downwardly within said drum.

4. The method of claim 1 wherein said spraying, accumulating and immersing steps successively repeat as a result of the work piece repeatedly tumbling between said tote and said drum as said drum rotates.

5. The method of claim 1 further comprising:

heating said supply of water prior to said spraying.

6. The method of claim 1 further comprising:

pressurizing said supply of water prior to said spraying.

7. The method of claim 1 further comprising:

evacuating accumulated vapor within said drum with an exhaust fan operatively mounted to a wash cabinet housing said drum.

8. The method of claim 1 further comprising:

collecting said supply of water after said spraying;

filtering said water which has been collected; and recycling said water which has been filtered for subsequent cleaning operations.

9. The method of claim 1 further comprising:

rinsing the work piece within said drum after said spraying and said immersing to thereby cool the work piece, said drum and said tote.

10. The method of claim 1 further comprising:

drying the work piece and said tote within said drum after said spraying, accumulating and immersing steps.

11. A method of cleaning a work piece comprising the steps of:

placing the work piece within a tote, said tote being open on an uppermost side thereof;

removably securing said tote within a drum such that said uppermost side is open toward an interior of said drum;

rotating said drum about a horizontal axis to thereby repeatedly tumble the work piece within said drum and said tote being secured therein;

heating a supply of water;

pressurizing said supply of water;

spraying said supply of water onto the work piece from at least one stepped expansion nozzle being fixedly mounted within said drum, a portion of said supply of water vaporizing to steam during said spraying to thereby release kinetic energy and increase the velocity of a remainder of said supply of water during said spraying;

accumulating a supply of sprayed water into a bath in said tote after being a sprayed onto the work piece; and immersing the work piece in said bath.

12. The method of claim 11 wherein said spraying is direct impingement spraying of the work piece.

13. The method of claim 11 wherein said spraying is directed downwardly within said drum.

14. The method of claim 11 wherein said supply of water is heated to above 310° F.

15. The method of claim 11 wherein said supply of water is pressurized to above 100 psi to thereby maintain said supply of water in a liquid state prior to said spraying.

16. The method of claim 11 wherein said spraying, accumulating and immersing steps successively repeat as a result of the work piece repeatedly tumbling between said tote and said drum as said drum rotates.

17. The method of claim 11 further comprising:

evacuating accumulated vapor within said drum with an exhaust fan operatively mounted to a wash cabinet housing said drum.

18. The method of claim 11 further comprising:

collecting said supply of water after said spraying;

filtering said water which has been collected; and recycling said water which has been filtered for subsequent cleaning operations.

19. The method of claim 11 further comprising:

rinsing the work piece within said drum after said spraying and said immersing to thereby cool the work piece, said drum and said tote.

20. The method of claim 11 further comprising:

drying the work piece and said tote within said drum after said spraying, accumulating and immersing steps.

21. A method of cleaning a work piece comprising the steps of:

placing the work piece within a drum which is perforate on one side and imperforate on an opposite side;

rotating said drum about a horizontal axis to thereby repeatedly tumble the work piece within said drum;

spraying a supply of water downwardly onto the work piece from at least one nozzle fixedly mounted against rotation within said drum; and accumulating a supply of sprayed water into a bath in said imperforate opposite side of said drum after being sprayed onto the work piece as said imperforate side of said drum passes beneath said at least one nozzle, whereby the work piece is repeatedly subject to spraying from said at least one nozzle and immersion in said bath.

22. The method of claim 21 further comprising:

heating said supply of water prior to said spraying.

23. The method of claim 21 further comprising:

pressurizing said supply of water prior to said spraying.

24. The method of claim 21 further comprising:

evacuating accumulated vapor within said drum with an exhaust fan operatively mounted to a wash cabinet housing said drum.

25. The method of claim 21 further comprising:

collecting said supply of water after said spraying;

filtering said water which has been collected; and recycling said water which has been filtered for subsequent cleaning operations.

26. The method of claim 21 further comprising:

rinsing the work piece within said drum after said spraying and said immersing to thereby cool the work piece and said drum.

27. The method of claim 21 further comprising:

drying the work piece within said drum after said spraying, accumulating and immersing steps.

28. A method of cleaning a work piece comprising the steps of:

placing the work piece within a tote, said tote having a perforate cover on an uppermost side thereof;

removably securing said tote within a drum such that said uppermost side is toward an interior of said drum;

rotating said drum about a horizontal axis, said work piece remaining in said tote during rotation of said drum;

spraying a supply of water onto the work piece from at least one nozzle being fixedly mounted within said drum;

accumulating a supply of sprayed water into a bath in said tote during a portion of said rotation of said drum; and immersing the work piece in said bath.

29. The method of claim 28 wherein said spraying is direct impingement spraying of the work piece.

30. The method of claim 28 wherein said spraying is directed both downwardly and upwardly within said drum.

31. The method of claim 28 wherein said spraying, accumulating and immersing steps successively repeat as a result of the drum rotation.

32. The method of claim 28 further comprising:

heating said supply of water prior to said spraying.

33. The method of claim 28 further comprising: pressurizing said supply of water prior to said spraying.

34. The method of claim 28 further comprising:

evacuating accumulated vapor within said drum with an exhaust fan operatively mounted to a wash cabinet housing said drum.

35. The method of claim 28 further comprising:

collecting said supply of water after said spraying;

filtering said water which has been collected; and recycling said water which has been filtered for subsequent cleaning operations.

36. The method of claim 28 further comprising:

rinsing the work piece within said drum after said spraying and said immersing to thereby cool the work piece, said drum and said tote.

37. The method of claim 28 further comprising:

drying the work piece and said tote within said drum after said spraying, accumulating and immersing steps.

* * * * *